US005256185A

United States Patent [19]

Semel et al.

[11] Patent Number: 5,256,185

[45] Date of Patent: Oct. 26, 1993

[54] METHOD FOR PREPARING BINDER-TREATED METALLURGICAL POWDERS CONTAINING AN ORGANIC LUBRICANT

[75] Inventors: Frederick J. Semel, Riverton, N.J.; Sydney Luk, Lafayette Hill, Pa.

[73] Assignee: Hoeganaes Corporation, Riverton, N.J.

[21] Appl. No.: 915,116

[22] Filed: Jul. 17, 1992

[51] Int. Cl.[5] ..... B22F 1/00

[52] U.S. Cl. ..... 75/255; 75/252; 419/35

[58] Field of Search ..... 419/30, 34, 36, 35; 428/570; 75/255, 252; 106/403

[56] References Cited

U.S. PATENT DOCUMENTS

| | | | |
|---|---|---|---|
| **4,483,905** | 11/1984 | Engstrom | 428/570 |
| 4,676,831 | 6/1987 | Engstrom | 75/252 |
| 4,834,800 | 5/1989 | Semel | 106/403 |
| 4,955,798 | 9/1990 | Museila et al. | 419/31 |
| 5,069,714 | 12/1991 | Gosselin | 75/252 |

OTHER PUBLICATIONS

*Handbook of Powder Metallurgy*, Ed. Henergy H. Hausner, Chemical Publishing Co. Inc., pp. 126–143.

*Primary Examiner*—Donald P. Walsh
*Assistant Examiner*—Anthony R. Chi
*Attorney, Agent, or Firm*—Woodcock Washburn Kurtz Mackiewicz & Norris

[57] ABSTRACT

Methods for preparing metallurgical powders containing an organic lubricant are provided. The powders are prepared by wetting a dry admixture of an iron-based powder, at least one alloying powder, and a first organic lubricant with an organic binding agent that is preferably dissolved or dispersed in a solvent. After removal of the solvent, the dried powder composition is admixed with a second organic lubricant.

24 Claims, No Drawings

METHOD FOR PREPARING BINDER-TREATED METALLURGICAL POWDERS CONTAINING AN ORGANIC LUBRICANT

FIELD OF THE INVENTION

The present invention relates to improved methods for preparing metallurgical powder compositions of the kind containing an organic lubricant. More specifically, the methods relate to the preparation of powder compositions which contain an iron-based powder, an alloying powder, a binding agent, and an organic lubricant where the lubricant is incorporated into the composition in two steps, providing improved powder characteristics and enabling the adjustment of the apparent density of the powder.

BACKGROUND OF THE INVENTION

In the art of powder metallurgy, iron or steel powders are often admixed with one or more alloying elements, also in particulate form, followed by compaction and sintering. Because of their very fine size, these alloying powders are susceptible to the separatory phenomena known as dusting and segregation, but the incorporation of binding agents into the compositions reduces these problems, enhancing the homogeneity of the composition and therefore of the final sintered part. See, for example, U.S. Pat. No. 4,834,800 to Semel and U.S. Pat. No. 4,483,905 to Engstrom.

Metal powder compositions are also generally provided with a lubricant, such as a metal stearate, a paraffin, or a synthetic wax, in order to facilitate ejection of the compacted component from the die. The friction forces that must be overcome in order to remove a compacted part from the die, which generally increase with the pressure used to compact the part, are measured as the "stripping" and "sliding" pressures. The lubricants reduce these pressures.

Hundreds of thousands of tons of iron and steel powders worldwide are mixed each year and most of it, probably upwards of 95%, is done without the use of binders or, for that matter, even any consideration of the use of such. The addition of lubricants to these mixes is simple even to the point of being completely artless. Although lubricant type and content are important issues, method of addition is not. Accordingly, the lubricants are added directly along with the balance of the admix ingredients.

With the advent of bonding to prevent segregation and dusting and, particularly, with the use of solid binders as dispersed from solvent solutions, the method of lubricant addition and, more specifically, the timing of the addition relative to that of the binder additions has along with the issues of type and content also become an important issue.

In the very early development of the bonding technology, the aim was to achieve identically the same powder properties in a bonded mix as would be observed in the same composition mix but without bonding. The powder properties referred to include, particularly, the apparent density (ASTM B212-76), the flow rate (ASTM B213-77), the green density (ASTM B331-76) and the green strength (ASTM B312-76). Studies in connection with the development of the solid binders claimed in U.S. Pat. No. 4,834,800 showed that the best way to achieve parity with respect to these properties in a bonded mix versus an unbonded mix was to make the lubricant additions after the binder addition. More specifically, in this method, the iron-based powder and alloying powders are first mechanically blended, then a binding agent, (always) either dissolved or dispersed in a solvent, is thoroughly blended into the mixture and the solvent removed, usually by application of heat and vacuum, and finally at this point, the lubricants, (there could be more than one), in particulate form are added to the dry bonded powder mixture. The lubricant addition step may be carried out in the same vessel as employed to do the bonding treatment or, in a different vessel. In any case, the generally observed effects of this method of processing on the properties of the resultant mixes relative to unbonded mixes of the same composition were (1) to increase the apparent density slightly but not significantly; (2) to increase the flow rate by about 10%; (3) to decrease green strength by about 10%; and (4) to leave green density largely unaffected in the density range from about 6.2 g/cm$^3$ to 6.9 g/cm$^3$ which was the range of predominant industrial interest at the time.

Later studies of the type which led to this method showed that another method of adding the lubricant led to significant increases in the flow rates of bonded mixes. Improved flow rates are advantageous in that they increase efficiency of the compaction processing. According to this method, referred to as "flow-bonding," the lubricant is added to the dry admixture of iron-based and alloying powders prior to the addition of the binder agent. Specifically, the iron-based powder and alloying powders are blended together with the particulate lubricant. A solution of the binder agent in an appropriate organic solvent is then mixed into the powders in order to fully wet the powders. Finally, the solvent is removed, leaving a dry, flowable powder. This method generally increases the flow rate by as much as 25–75% as compared to the lubricated, non-bonded powder. However, this method typically increases the apparent density of the powder, usually by about 0.1 to about 0.25 g/cm$^3$. Such a powder, although having the desired elemental composition and flow properties, may not be usable in retrofit applications involving fixed-fill compaction dies that have a limited latitude for accepting these higher apparent densities.

Therefore, a need exists in the powder metallurgical art for a method to prepare the metallurgical powder composition in which certain properties of the powder, especially the apparent density, can be altered while retaining desirable flow characteristics and not significantly altering other "green" (compacted) and sintered properties.

SUMMARY OF THE INVENTION

The present invention provides improved methods for preparing a bonded metallurgical powder composition of the kind containing an organic lubricant. According to the method, a dry admixture of an iron-based powder, at least one alloying powder, and a first amount of an organic lubricant is formed, preferably using conventional dry-blending techniques. A liquid mixture of an organic binding agent that is dissolved or dispersed in a solvent is provided and the powder admixture is wetted with this liquid mixture. Thereafter, the solvent is removed, leaving a dry, flowable powder composition. To this dry powder composition is then added a second amount of an organic lubricant, preferably in particulate form, to provide the metallurgical powder composition.

The total of the first and second amounts of lubricant constitutes up to about 3 percent, preferably up to about 2 percent, and most preferably from about 0.5 to about 1.5 percent, by weight of the metallurgical powder composition. The amount of the second lubricant is up to about 25 percent by weight of the total of the first and second lubricant amounts.

The two-step addition of the lubricant, and specifically the post-addition of the second amount of lubricant in a dry, particulate form, provides a method to modify or fine-tune the apparent density of the metallurgical powder composition without significantly adversely affecting other properties such as flow, green strength, or compressibility of the powder. Although in some instances a decrease in one or more of these properties may occur, the ability to adjust the apparent density is an offsetting, and generally greater, benefit. Therefore, the apparent density of a binder-containing and lubricant-containing metallurgical powder composition can be adjusted to meet a specific die requirement by the post-addition of a minor amount of additional organic lubricant.

DETAILED DESCRIPTION OF THE INVENTION

An improved method for preparing a metallurgical powder composition of the kind containing an iron-based powder, an alloying powder, an organic binding agent, and an organic lubricant is set forth herein. The present method provides a method of preparing a metallurgical powder composition through which the apparent density of the composition can be manipulated by the addition of the lubricant in two steps. The lubricant is added to the powder composition both before and after the addition of a binding agent to the composition. The metallurgical powder composition can then be compacted and sintered by conventional means.

The metallurgical powder composition is prepared by first forming a dry admixture of an iron-based powder, at least one alloying powder, and a first amount of an organic lubricant. This admixture is formed by conventional solid-particle blending techniques to form a substantially homogeneous particle blend.

The iron-based particles that are useful in the invention are any of the iron or iron-containing (including steel) particles that can be admixed with particles of other alloying materials for use in standard powder metallurgical methods. Examples of iron-based particles are particles of pure or substantially pure iron; particles of iron pre-alloyed with other elements (for example, steel-producing elements); and particles of iron to which such other elements have been diffusion-bonded, but not alloyed. The particles of iron-based material can have a weight average particle size up to about 500 microns, but generally the particles will have a weight average particle size in the range of about 10–350 microns. Preferred are particles having a maximum average particle size of about 150 microns, and more preferred are particles having an average particle size in the range of about 70–100 microns.

The preferred iron-based particles for use in the invention are highly compressible powders of substantially pure iron; that is, iron containing not more than about 1.0% by weight, preferably no more than about 0.5% by weight, of normal impurities. Examples of such metallurgical grade pure iron powders are the water atomized ANCORSTEEL ® 1000 series of iron powders (e.g. 1000, 1000B, and 1000C) available from Hoeganaes Corporation, Riverton, N.J. ANCORSTEEL ® 1000 iron powder, for example, has a typical screen profile of about 22% by weight of the particles below a No. 325 sieve and about 10% by weight of the particles larger than a No. 100 sieve with the remainder between these two sizes (trace amounts larger than No. 60 sieve). The ANCORSTEEL ® 1000 powder has an apparent density of about 2.85–3.00 g/cm$^3$, typically about 2.94 g/cm$^3$. The method is also applied to mixtures of kiln reduced iron powders such as Hoeganaes Ancor MH100 and Ancor MH101 powders.

An example of a pre-alloyed iron-based powder is iron pre-alloyed with molybdenum (Mo), a preferred version of which can be produced by atomizing a melt of substantially pure iron containing from about 0.5 to about 2.5 weight percent Mo. Such a powder is commercially available as Hoeganaes Ancorsteel ® 85HP steel powder, which contains 0.85 weight percent Mo, less than about 0.4 weight percent, in total, of such other materials as manganese, chromium, silicon, copper, nickel, or aluminum, and less than about 0.02 weight percent carbon.

The diffusion-bonded iron-based particles are particles of substantially pure iron that have a layer or coating of one or more other metals, such as steel-producing elements, diffused into their outer surfaces. One such commercially available powder is DISTALOY 4600A diffusion bonded powder from Hoeganaes Corporation, which contains 1.8% nickel, 0.55% molybdenum, and 1.6% copper.

The alloying materials that are admixed with iron-based particles of the kind described above are those known in the metallurgical arts to enhance the strength, hardenability, electromagnetic properties, or other desirable properties of the final sintered product. Steel-producing elements are among the best known of these materials. Specific examples of alloying materials include, but are not limited to, elemental molybdenum, manganese, chromium, silicon, copper, nickel, tin, vanadium, columbium (niobium), metallurgical carbon (graphite), phosphorus, aluminum, sulfur, and combinations thereof. Other suitable alloying materials are binary alloys of copper with tin or phosphorus; ferro-alloys of manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum.

The alloying materials are used in the composition in the form of particles that are generally of finer size than the particles of iron-based material with which they are admixed. The alloying-element particles generally have a weight average particle size below about 100 microns, preferably below about 75 microns, more preferably below about 30 microns, and most preferably in the range of about 5–20 microns. The amount of alloying material present in the composition will depend on the properties desired of the final sintered part. Generally the amount will be minor, up to about 5% by weight of the total powder weight, although as much as 10–15% by weight can be present for certain specialized powders. A preferred range suitable for most applications is about 0.25–4.0% by weight.

The organic lubricant is selected from any of the well known powder metallurgical lubricants. These lubricants include such compounds as metal stearates or other soaps, paraffins, synthetic waxes, and natural and synthetic fat derivatives. Preferred lubricants are those that either pyrolyze cleanly during sintering or, otherwise, decompose without adverse effect to the sintering process. Examples of such lubricants are various naturally occurring and synthetic soaps and waxes. Included among the soapy materials which are preferred are stearic acid and the metallic stearates of zinc and lithium. Other metallic stearates including those of copper, nickel and iron are on occasion also used a special purpose lubricants. Among the waxes are the naturally occurring long-chained paraffins or synthetic polyethylenes and, chiefly, the ethylene bis-stearamides or ethylene bis-stearmide based lubricants. Commercially available examples of such waxes include Acrawax C and PM-100 from Glyco Corporation, Ferrolube from Zeller Interchem Corp., and Kenolube from Höganäs AG of Sweden.

Another example of an organic lubricant is an amide lubricant that is essentially a high melting-point wax. This lubricant is described in U.S. Pat. No. 5,154,881. The amide lubricant is the reaction product of about 10-30% by weight of a $C_6$-$C_{12}$ linear dicarboxylic acid, about 10-30% by weight of a $C_{10}$-$C_{22}$ monocarboxylic acid, and about 40-80% by weight of a diamine having the formula $(CH_2)_x(NH_2)_2$ where x is 2-6. The amide lubricant is formed as the condensation product by contacting the reactants at a temperature of about 260° C.-280° C. at a pressure up to about 7 atmospheres. The reaction is usually conducted in an inert atmosphere in the presence of a catalyst such as methyl acetate and zinc powder. This lubricant is preferred when the composition is to be compacted at elevated temperatures (warm compaction), such as from about 150° C. (300° F.) to about 370° C. (700° F.). A preferred amide lubricant is commercially available as ADVAWAX® 450 amide (an ethylene bis-stearamide) sold by Morton International of Cincinnati, Ohio.

The first amount of lubricant will generally be added to the composition in the form of solid particles. The weight average particle size of the lubricant can vary, but is preferably below about 50 microns. Most preferably the lubricant particles have a weight average particle size of about 5-20 microns. The lubricant is homogeneously admixed into the dry blend of iron-based and alloying powders. This first amount of lubricant can be a single lubricant or a mixture of the lubricants described above.

An organic binding agent is then incorporated into the dry admixture of the iron-based powder, alloying powder, and lubricant. The binding agent is useful to prevent segregation and/or dusting of the alloying powders or any other special-purpose additives commonly used with iron or steel powders. The binding agent therefore enhances the compositional uniformity and alloying homogeneity of the final sintered metal parts.

The binding agents that can be used in the present method are those commonly employed in the powder metallurgical arts as illustrated in U.S. Pat. No. 4,483,905 and U.S. Pat. No. 4,834,800, which are incorporated herein by reference. Such binders include polyglycols such as polyethylene glycol or polypropylene glycol, glycerine, polyvinyl alcohol, homopolymers or copolymers of vinyl acetate; cellulosic ester or ether resins, methacrylate polymers or copolymers, alkyd resins, polyurethane resins, polyester resins, and combinations thereof. Other examples of binding agents which are applicable are the high molecular weight polyalkylene oxide based compositions described in our co-pending, commonly assigned U.S. application Ser. No. 848,264 filed Mar. 9, 1992.

The binding agent can be added to the powder mixture according to the procedures taught by U.S. Pat. No. 4,483,905 and U.S. Pat. No. 4,834,800. Generally, the binding agent is added in a liquid form and mixed with the powders until good wetting of the powders is attained. Those binding agents that are in liquid form at ambient conditions can be added to the powder as such, but it is preferred that the binder, whether liquid or solid, be dissolved or dispersed in an organic solvent and added as this liquid solution, thereby providing substantially homogeneous distribution of the binder throughout the mixture. The wet powder is thereafter processed using conventional techniques to remove the solvent. Typically, if the mixes are small, generally 5 lbs. or less, the wet powder is spread over a shallow tray and allowed to dry in air. On the other hand, in the case of large mixes, such as the 550 lb. ones used to develop the examples, the drying step is accomplished in the mixing vessel by employing heat and vacuum.

The amount of binding agent to be added to the powder composition depends on such factors as the density and particle size distribution of the alloying powder, and the relative weight of the alloying powder in the composition, as discussed in U.S. Pat. No. 4,834,800 and in co-pending application Ser. No. 848,264 filed Mar. 9, 1992. Generally, the binder will be added to the powder composition in an amount of about 0.005-1% by weight, based on the total weight of the powder composition.

After the binder treatment step has been completed, a second amount of organic lubricant is admixed with the now dried powder composition using conventional blending techniques to form the final mixture. It has been found that the apparent density of the mixture can be adjusted either upwards or downwards depending upon the type and amount of the lubricant used. As a general matter, the metallic soap type lubricants are found to increase the apparent density whereas the natural and synthetic wax type lubricants decrease it. The amount of the addition in either case will typically not exceed about 25% of the total final lubricant content of the mixture.

The metallic soaps found applicable to increasing the apparent density include the stearates of copper, nickel, iron, zinc and lithium. The preferred lubricants in this group are those of zinc and lithium. The natural and synthetic waxes found applicable to reducing the apparent density include paraffin, ethylene bis-stearmide, polyethylene, polyethylene glycol and various commercially available wax based lubricants wherein one of the foregoing is a principal ingredient. The preferred lubricants within this group include Acrawax C and PM100 from Glyco Corporation, Ferrolube from Zeller Interchem Corp., and Kenolube from Höganäs AG in Sweden.

The total amount of lubricant to be added to the metallurgical powder composition depends upon the properties desired or necessary in the powder composition or the compacted green part. Generally, the total of the first and second lubricants is up to about 3%, preferably up to about 2%, and most preferably about 0.5-1.5%, of the total weight of the metallurgical powder composition.

The quantity of lubricant to be added as the second amount of lubricant is dependent on the desired degree of adjustment to be made to the apparent density of the powder composition. The addition of even small quantities of lubricant in this second step can have significant effects on the apparent density. The upper limit for the addition of the second lubricant is generally dictated by the adverse effects upon other powder properties. In terms of the relative weights of the first and second lubricant additions, the second amount of lubricant is generally up to about 25% by weight, preferably about 1-25% by weight, more preferably about 10-20% by weight, and most preferably about 5-15% by weight, of the total lubricant addition.

In use, the powder composition obtained by the improved method of this invention is compacted in a die according to conventional metallurgical techniques. Typically the compaction pressure is about 5-100 tons per square inch (69-1379 MPa), preferably about 20-100 tsi (276-1379 MPa), and more preferably about 25-70 tsi (345-966 MPa). After compaction, the part is sintered according to conventional metallurgical techniques.

EXAMPLE

A metallurgical powder composition was prepared in accordance with the method of the present invention. A preheated, dry admixture of an iron-based powder composition was prepared. The admixture contained 0.9% wt. powdered graphite as an alloying element and 0.75% wt. zinc stearate as a lubricant. Specifically about 541.0 pounds of Ancorsteel ® 1000 powder, 5.0 pounds of graphite Ashbury Graphite Grade 3202, and 4.0 pounds of zinc stearate Mallinkrodt Flomet Z were dry-blended into a substantially homogeneous batch. To this powder mixture was added about 6 pounds of a 10 wt. % solution of polyvinyl acetate in acetone (in order to provide a powder mix containing about 0.11 wt. % binder after drying). Blending was continued until the powders were thoroughly wetted. The wet powder was then submitted to vacuum conditions to dry it by evaporating the solvent.

The dried powder blend was divided into eleven 50-pound batches. Five batches were subsequently modified by addition of zinc stearate lubricant in increments of 0.025 pounds (0.05% of the original batch weight), up to a maximum of an additional 0.125 pounds (0.25% of the batch weight; about 25% of the total lubricant content). Another five batches were modified by the addition of ACRAWAX C lubricant in the same amounts and increments.

The effects of the post-addition of lubricant on the apparent density and flow characteristics of the metallurgical powder are shown in Table 1. The apparent density was determined according to ASTM B212-76; the flow rate was determined using the Hall method (ASTM B213-77). The apparent density and flow rates of the powder were determined at three points—after the addition of the first amount of lubricant but before incorporation of the binder (designated as the "pre-bonded" material); after the binder had been incorporated into the powder (designated as the "as-bonded" material); and after the second amount of lubricant had been added. The addition of zinc stearate increased the apparent density of the powder and also slightly increased the flow times as compared to the as-bonded material. The addition of ACRAWAX C lubricant decreased the apparent density and increased the flow times as compared to the as-bonded material. Nevertheless, the observed flowrates of these mixes were, in all cases, still substantially improved relative to the flowrates of the unbonded powders. For both zinc stearate and ACRAWAX C lubricant additions, the greatest effect on the apparent density occurred with the smallest additions. Simultaneously these additions had the least effect in increasing the flow time. Accordingly, the method of post lubricant addition enables suitable adjustment of the apparent density, either upwards or downwards, as desired, without significant effect on the flow rate.

TABLE I

| | TEST RESULTS | | | |
|---|---|---|---|---|
| | AFTER 24 HOURS | | AFTER ONE WEEK | |
| MIX CONDITION | APP. DENSITY g/cm³ | FLOW sec/50 g | APP. DENSITY g/cm³ | FLOW sec/50 g |
| Pre-Bonded | 3.13 | 37.0 | 3.15 | 37.6 |
| As-Bonded | 3.30 | 23.0 | 3.34 | 22.5 |
| WITH POST-ADDED ZINC STEARATE* | | | | |
| 0.05% | 3.40 | 24.3 | 3.42 | 23.2 |
| 0.10% | 3.44 | 24.4 | 3.47 | 23.5 |
| 0.15% | 3.46 | 28.3 | 3.47 | 24.6 |
| 0.20% | 3.44 | 29.0 | 3.45 | 25.8 |
| 0.25% | 3.43 | 26.5 | 3.45 | 26.2 |
| WITH POST-ADDED ACRAWAX LUBRICANT* | | | | |
| 0.05% | 3.17 | 27.8 | 3.18 | 27.5 |
| 0.10% | 3.12 | 28.7 | 3.14 | 28.3 |
| 0.15% | 3.06 | 29.8 | 3.08 | 29.2 |
| 0.20% | 3.05 | 29.7 | 3.07 | 29.2 |
| 0.25% | 3.03 | 30.3 | 3.06 | 30.0 |

*measured as percentage of total mixture weight

What is claimed is:

1. An improved method for preparing a metallurgical powder composition of the kind containing an organic lubricant comprising the steps of:

(a) providing a dry admixture of (i) an ironbased powder, (ii) at least one alloying powder, and (iii) a first amount of an organic lubricant;

(b) providing a liquid mixture of an organic binding agent dissolved or dispersed in a solvent;

(c) wetting said dry admixture with said liquid mixture;

(d) removing the solvent, thereby forming a dry powder composition; and (e) admixing a second amount of an organic lubricant selected from the group consisting of soaps and waxes with said dry powder composition to form said metallurgical powder composition;

wherein said second amount of organic lubricant is up to about 25 percent by weight of the total of said first and second amounts of organic lubricant, and wherein the total of said first amount and said second amount of organic lubricant constitutes up to about 3 percent by weight of said metallurgical powder composition.

2. The method of claim 1 wherein the total of the first and second lubricant amounts constitutes up to about 2 percent by weight of the metallurgical powder composition.

3. The method of claim 2 wherein the second amount of lubricant is about 1-25 percent by weight of the total of the first and second lubricant amounts.

4. The method of claim 2 wherein the second amount of lubricant is about 10-20 percent by weight of the total of the first and second lubricant amounts.

5. The method of claim 3 wherein the second lubricant is a metal stearate.

6. The method of claim 3 wherein the first lubricant and the second lubricant are a metal stearate.

7. The method of claim 3 wherein the second lubricant is an amide-containing wax.

8. The method of claim 3 wherein sufficient binding agent is present in said liquid mixture to provide an amount of about 0.005-1 percent by weight of said binding agent to said metallurgical powder composition.

9. The method of claim 8 wherein the binding agent is selected from the group consisting of:

(1) homopolymers or copolymers of vinyl acetate;
(2) cellulose ester or ether resins;
(3) methacrylate polymers or copolymers;
(4) alkyd resins;
(5) polyurethane resins;
(6) polyester resins;
(7) polyglycols;
(8) glycerine;
(9) polyvinyl alcohol; and
(10) combinations thereof.

10. The method of claim 8 wherein the total amount of the first and second lubricant is about 0.5-1.5 weight percent of the metallurgical powder composition.

11. A method for increasing the apparent density of a metallurgical powder composition comprising (i) an iron-based powder, (ii) at least one alloying powder, (iii) a binder, and (iv) a first organic lubricant, the method comprising admixing with said metallurgical powder composition a second organic lubricant that is a soap, wherein said second lubricant is up to about 25 percent by weight of the total of said first and second organic lubricants, and wherein the total of said first and said second lubricants constitutes up to about 3 percent by weight of said powder composition.

12. The method of claim 11 wherein the second lubricant is a metal stearate.

13. The method of claim 12 wherein the second lubricant constitutes about 1-25 percent by weight of the total weight of said first and second lubricants.

14. The method of claim 12 wherein the second lubricant constitutes about 10-20 percent by weight of the total weight of said first and second lubricants.

15. The method of claim 13 wherein the first lubricant comprises a metal stearate.

16. The method of claim 13 wherein the first lubricant comprises an amide-containing wax.

17. The method of claim 13 wherein the binding agent is selected from the group consisting of:

(1) homopolymers or copolymers of vinyl acetate;
(2) cellulose ester or ether resins;
(3) methacrylate polymers or copolymers;
(4) alkyd resins;
(5) polyurethane resins;
(6) polyester resins;
(7) polyglycols;
(8) glycerine;
(9) polyvinyl alcohol; and
(10) combinations thereof.

18. A method for decreasing the apparent density of a metallurgical powder composition comprising (i) an iron-based powder, (ii) at least one alloying powder, (iii) a binder, and (iv) a first organic lubricant, the method comprising admixing with said powder composition a second organic lubricant that is a wax, wherein said second lubricant is up to about 25 percent by weight of the total of said first and second organic lubricants and wherein the total of said first and said second lubricants constitutes up to about 3 percent by weight of said powder composition.

19. The method of claim 18 wherein the second lubricant is an amide-containing wax.

20. The method of claim 19 wherein the second lubricant constitutes about 1-25 percent by weight of the total of the first and second lubricants.

21. The method of claim 19 wherein the second lubricant constitutes about 10-20 percent by weight of the total of the first and second lubricants.

22. The method of claim 20 wherein the first lubricant is a metal stearate.

23. The method of claim 20 wherein the first lubricant is an amide-containing wax.

24. The method of claim 20 wherein the binding agent is selected from the group consisting of:

(1) homopolymers or copolymers of vinyl acetate;
(2) cellulose ester or ether resins;
(3) methacrylate polymers or copolymers;
(4) alkyd resins;
(5) polyurethane resins;
(6) polyester resins;
(7) polyglycols;
(8) glycerine;
(9) polyvinyl alcohol; and
(10) combinations thereof.

* * * * *